US010035630B1

(12) United States Patent
Bell

(10) Patent No.: US 10,035,630 B1
(45) Date of Patent: Jul. 31, 2018

(54) ODOR NEUTRALIZING FABRIC SHEATH

(71) Applicant: Quintavius L. Bell, Ovieda, FL (US)

(72) Inventor: Quintavius L. Bell, Ovieda, FL (US)

( * ) Notice: Subject to any disclaimer, the term of this patent is extended or adjusted under 35 U.S.C. 154(b) by 138 days.

(21) Appl. No.: 14/799,061

(22) Filed: Jul. 14, 2015

Related U.S. Application Data

(60) Provisional application No. 62/024,188, filed on Jul. 14, 2014.

(51) Int. Cl.
*B65D 51/12* (2006.01)
*B65D 51/24* (2006.01)

(52) U.S. Cl.
CPC ..... *B65D 51/24* (2013.01); *B65D 51/12* (2013.01); *B65D 2251/00* (2013.01)

(58) Field of Classification Search
CPC .... B65D 51/24; B65D 51/12; B65D 2251/00; B65D 2251/09
USPC ..... 220/254.1, 287; 4/253, 655, 657, 245.1, 4/245.5; 2/171.2, DIG. 901, 88, 94
See application file for complete search history.

(56) References Cited

U.S. PATENT DOCUMENTS 2,761,480 A * 9/1956 Tames ..... D06F 95/004 383/16
2,970,628 A * 2/1961 Tames ..... D06F 95/004 220/9.4
4,180,113 A * 12/1979 Liebling ..... D06F 95/004 220/9.1
4,646,802 A 3/1987 Basore et al.
5,016,774 A * 5/1991 Rodriguez ..... B44D 3/127 150/154
5,131,290 A * 7/1992 Atkinson ..... B62D 1/04 24/115 G
5,154,960 A 10/1992 Mucci et al.
5,242,074 A 9/1993 Conaway et al.
5,383,236 A * 1/1995 Sesselmann ..... A41D 13/00 2/1
5,464,113 A 11/1995 Ho et al.
2002/0051739 A1 5/2002 Wang
2003/0010415 A1* 1/2003 Szuszkiewicz ..... B65D 65/02 150/154
2006/0213911 A1* 9/2006 Settles ..... D06F 39/14 220/287
2014/0186224 A1* 7/2014 Derby Krans ..... A61L 9/014 422/120
2015/0168009 A1* 6/2015 Otway ..... F24F 13/20 150/165

* cited by examiner

*Primary Examiner* — James N Smalley
(74) *Attorney, Agent, or Firm* — Robert Varkonyi; Zagrebelsky Law P.A.

(57) ABSTRACT

Disclosed is a receptacle cover is formed from a horizontal wall and one or more vertical walls, and can be fitted or use elastic, drawstrings or other means to fit multiple container sizes such as laundry hampers/baskets, diaper pales, and storage bins. The cover includes an odor eliminator having one or more odor eliminating compounds embedded in sheets, which may be fixed or detachable or incorporated into the cover. Multiple odor-eliminating sheets may be used for heavily soiled or contaminated articles to eliminate unpleasant and lingering aromas. Alternatively, a plastic sheet holder embedded below the cover has multiple tiny holes to aid ventilation and allow odor absorption from flexible non-woven polyester fiber sheets. The fabric sheath cover may be hand-washed or cycled in cold water and tumble dry with very low or no heat.

16 Claims, 12 Drawing Sheets

ODOR NEUTRALIZING FABRIC SHEATH

FIELD OF INVENTION

This invention relates to odor absorbing materials. More specifically, the present invention provides a fabric sheath having interwoven odor eliminating members.

BACKGROUND OF THE INVENTION

Over 300 million US citizens use covered or non-covered household containers withholding unpleasant odors resulting from everyday life situations or just stale environment. Various receptacles, such as baskets/hampers, diaper pales, storage containers, are used to store and transport dirty and soiled articles or clothing, for later disposal or cleaning. Many of these receptacles are typically is made of hard, non-flexible materials, and in various sizes and shapes. The receptacles commonly have a pivoting lid to prevent unsightly appearance as well as to contain malodorous odors. However, conventional lids or tops only stifle the smell temporarily by covering them up, and do not address the foul odors generated in the receptacle or the released odors lingering in the air after each use of the receptacle.

Various compounds found in body wastes contribute to odors, also known as malodors, such as triethylamine, pyridine, furaldehyde, isovaleric acid, and n-propyl sulfide, as noted by Weber, et al. (U.S. Pat. No. 5,161,686), along with E-3-methyl-2-hexenoic acid (E-3M2H) and 3-hydroxy-3-methyl-hexanoic acid (HMHA), sulfanylalkanols and, 3-methyl-3-sulfanylhexan-1-ol (3M3SH), androstenone (5α-androst-16-en-3-one) and androstenol (5α-androst-16-en-3α-ol), that are broken down into organic acids, aldehydes, ketones, mercaptans, methanethiol, ammonia, and indoles. Various bacterial and microbiota possess lipases that break down fats into butyric acid, or other enzymes that break down amino acids into propionic acid.

The problems associated with obnoxious odors from these devices are similarly are well known. For example, while a lid or covering may temporally trap the smell in the receptacles, each time a lid cover is elevated and return back down from a receptacle, a foul odor is release which lingers in the air; especially in instances where items are stored for 3-4 days and where the articles consist of dirty, moist laundry, smoky laundry, or soiled diapers. Moreover, residential or commercial receptacles can leave an awful lingering smell up to 75 feet from the receptacle station, depending on the level of odor. The odors emanating from such receptacles oftentimes attract insects or rodents, resulting in unsanitary conditions.

Attempts have been made to conceal or reduce and eliminate odors from baskets/hampers, diaper pales, storage containers. For example, U.S. Pat. No. 5,242,074 to Conwawy, et al. discloses a hamper design allowing air flow to reduce moisture from clothing and thereby reduce odors. U.S. Pat. No. 5,154,960 to Mucci, et al. provides a flexible sheet having odor absorbing granules are bonded to the surface of the sheet using adhesive. Similarly, U.S. application Ser. No. 09/969,051 to Wang discloses an ozone-generating device which is used to break down and eliminate organic odors, such as those associated with such containers.

U.S. Pat. No. 3,346,140 to Sidney, U.S. Pat. No. 4,427,110 to Shaw, Jr., and U.S. Pat. No. 2,620,228 to Oscar, et al. disclose devices that hold deodorant in a receptacle to reduce odors, and U.S. Pat. No. 3,102,661 to Lundquist discloses a receptacle having deodorant applied to the lid. U.S. Pat. No. 2,802,590 to Tupper discloses a scent dispenser to mask the odor with scents. U.S. Pat. No. 5,161,686 to Weber, et al. discloses odor-absorbing porous materials, such as zeolite, mixed with an alkaline salt or alkaline earth oxide particulate, for removing odors. The odor-absorbing materials can also include activated carbon, activated silica gel, polymeric absorbent materials, molecular sieves, ion exchange resins and other carbonaceous absorbent materials. Weber, et al. also discloses incorporating the zeolite into fibers of the matrix by mixing the zeolite with low-melting thermoplastic synthetic material in a molten state, forming strands by pressurizing the molten synthetic material, and preparing textile from the strands. The odor-absorbing materials can be fixed in a base web matrix. Compounds useful for mixing the odor-absorbing materials in the matrix include water-emulsion asphaltic-type of adhesives, synthetic resinous or latex base adhesives and plasticizers.

However, these prior solutions have not fulfilled the need to eliminate odors from baskets, hampers, diaper pales, storage containers.

SUMMARY OF THE INVENTION

A receptacle cover is provided for eliminating odors. The receptacle cover comprises at least one piece of fabric, forming at least a horizontal wall with an opening on the horizontal wall. The fabric is either a horizontal wall or at least one vertical wall and a horizontal wall. Optionally, the at least one vertical wall further comprises a first vertical wall, a second vertical wall, a third vertical wall, and a fourth vertical wall, where the first vertical wall, the second vertical wall, the third vertical wall, and the fourth vertical wall are disposed to form a polygon. A fabric lid is connected to the horizontal wall by a seam along a first edge. The lid is dimensioned to cover the opening disposed on the horizontal wall. In certain embodiments of the invention, a handle is disposed opposite the first edge of the lid. In more specific variations, a knot disposed on the handle, where the handle is fabric.

A casing is attached to the one piece of fabric, either to the horizontal wall or the at least one vertical wall, by a seam. A tightener is placed in the casing. The tightener is optionally an elastic band, an elastic cord, or a non-elastic cord. Nonlimiting examples include bungee cord, a draw string, or an elastic band. The tightener can be a continuous piece of material, i.e. a circular tightener, or a single piece having two ends. In some embodiments, the tightener further comprises a lock disposed on the tightener. The lock is adapted to accept a plurality of ends of the tightener, such that the lock fits on the tightener. The lock is adapted to secure the tightener at a selected length.

The fabric is optionally an odor-eliminating material; or the fabric is not an odor-eliminating material. Options include bamboo charcoal-doped synthetic fabric, bamboo charcoal-doped cotton, bamboo charcoal-doped bamboo fabric linen, cotton, silk, polyester, woven cotton, or a combination thereof. Where the fabric is not an odor-eliminating material, an odor eliminator is provided on the horizontal wall or the at least one vertical wall. Examples of odor eliminators include activated carbon fiber, activated carbon non-woven fabric, bamboo charcoal, or a combination thereof. The odor eliminator optionally includes an odor eliminating compound in some embodiments. The odor eliminating compound is optionally baking soda, white vinegar, activated carbon, essential oils, or a combination thereof. The odor eliminator is optionally fixed to the horizontal wall by adhesive, sewing, snaps, zippers, hook and loop fasteners, buttons, acrylic gel, fusable webbing, or fusable material.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
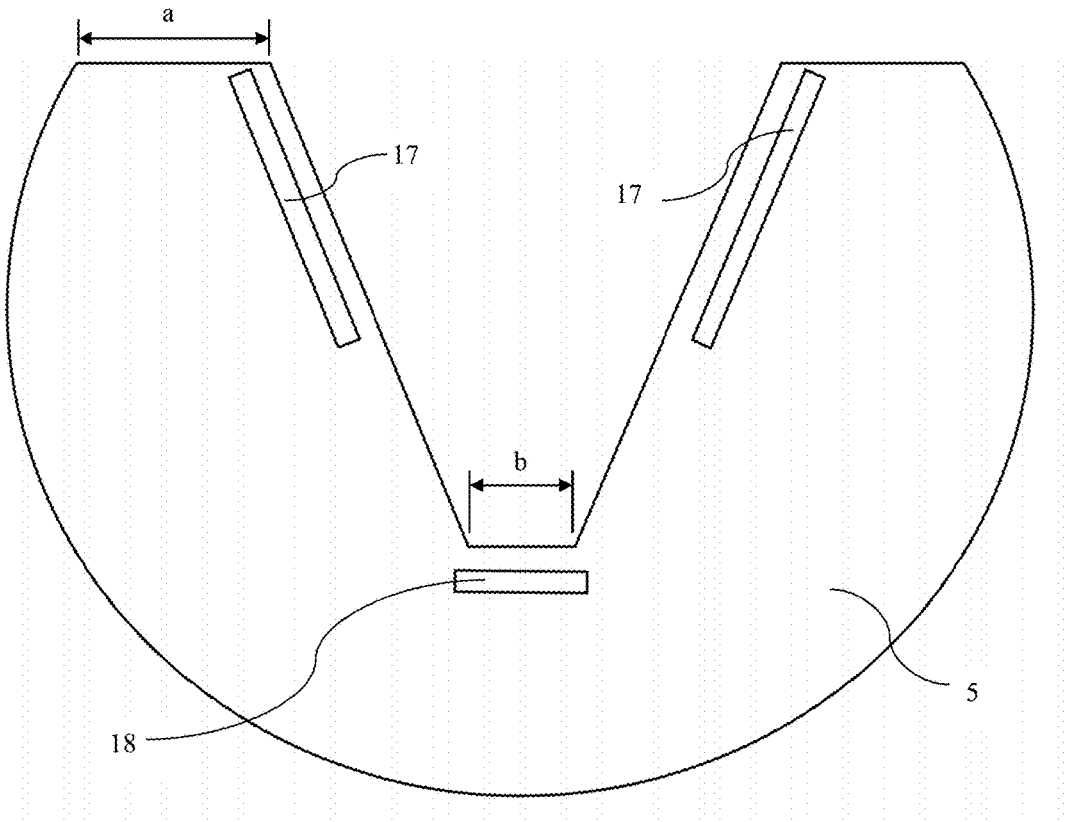
FIG. 1 is an illustration of the cover top for an embodiment of the invention.

As used herein, the singular forms "a," "an" and "the" include plural referents unless the context clearly dictates otherwise. Thus, for example, reference to "an insert" includes a single element or two or more elements.

As used herein, "about" means approximately or nearly and in the context of a numerical value or range set forth means±15% of the numerical.

As used herein, "adapted to secure" means the lock possesses at least one device which engages the tightener thereby preventing the tightener from increasing in length. Nonlimiting examples include friction locks, such as a spring-loaded cylinder or block designed to clamp on the tightener, a ratcheted cylinder or block designed to clamp on the tightener.

As used herein, "nanoparticle" means a molecule with at least one dimension being in the nanometer size, i.e. below 1 μm.

As used herein, "odor transparent" means odors transmit through the medium with little to no appreciable scattering, i.e. odor molecules can freely diffuse or permeate through the material. Examples include mesh, plastics having pore sizes at least 1.25× the size of the odor molecule, burlap, include cotton, nylon, rayon, linen, hemp, wool, silk, denim and synthetic fabrics.

As used herein, "seam" means the attachment of two or more pieces of fabric using at least two rows of stitches.

As used herein, "selected length" means the length of a recited item as determined by a user.

As used herein, "wall" means a barrier. The wall may be one or more sheets of fabric used to define an area.

Example 1

Material for the cover is manufactured from bamboo charcoal fabric, which provides an ecologically-friendly odor-eliminating material. Bamboo fibers are heated to a temperature of between 800-1000° C., causing the bamboo to form charcoal. The bamboo charcoal is processed into nanoparticles. Using nanotechnologies these bamboo charcoal nanoparticles are then blended together with organic bamboo fibers and woven into yarn or fused with synthetic textiles, such as those disclosed in Chinese Application CN 201320365410 drawn to bamboo charcoal-blended polyester textiles and Lai, et al. (U.S. Pat. No. 8,163,663) drawn to the manufacture of bamboo charcoal-laden synthetic textiles. Bamboo charcoal yarn is used to make the various textiles. Alternatively, the bamboo is processed using chemical baths and reconstituted into a yarn that can be incorporated into other textiles, such as cotton, nylon, rayon, linen, hemp, wool, silk, cotton, and polyester. However, other textile materials can be used.

As an example, bamboo is processed, removing the outer trunk and leaves from the inner pith, and the pith crushed and soaked in a sodium hydroxide solution. In some examples, the sodium hydroxide solution is between 15% and 20%. The sodium hydroxide bath can be performed at between 20° C. and 25° C. and for a time of up to three hours. It is noted that the timing and temperature can vary, though the processing must be performed until a cellulose material is formed. The alkali bamboo cellulose material is then separated from the sodium hydroxide solution by methods known in the art, such as pressing. The remaining alkali bamboo cellulose material is then crushed and dried. The dried material is added to carbon disulfide causing the alkali bamboo cellulose material to cross-link via sulfurization, resulting in a cellulose gel. The cellulose gel is permitted to dry, with any remaining carbon disulfide is removed by evaporation, resulting in a cellulose sodium xanthogenate. A diluted solution of sodium hydroxide is added to the cellulose sodium xanthogenate, forming a viscous solution. The viscous solution consists of about 5% sodium hydroxide and about 7% to about 15% bamboo fiber cellulose. The viscous solution is run through spinneret nozzles and into a solution of diluted sulfuric acid, causing the stream of the viscous solution to harden into cellulose bamboo fiber threads. The cellulose bamboo fiber threads are then spun into fiber yarn. In some embodiments, the yarn is integrated with other textiles to form bamboo charcoal-doped fabrics. Examples of the second textile material used in the bamboo charcoal-dopes fabrics includes synthetic fabric, like nylon, rayon, and polyester, cotton, linen, hemp, silk, wool, or woven cotton.

Advantageously, bamboo charcoal fabric has a highly porous structure, resulting in a surface area of about 200 to 300 $m^2$ per 1 g. This provides significant ability to absorption malodors from clothing, such as around 16% to around 19.39% of formaldehyde, around 8.69% to around 10.08% for benzene, around 5.65% to around 8.42% for toluene, around 22.73% to around 30.65% for ammonia, and up to 40.68% for chloroform. Further, as bamboo charcoal contains about 93% to about 96% carbon, it readily absorbs sulfur-based compounds and nitrogen-based compounds. Bamboo charcoal also possesses compounds that inhibit bacterial metabolism, called bamboo kun (kuhn) that also reduced odors formed on worn clothing. The American Association for Testing and Materials ASTME2149-2001 determined the antibacterial activity of bamboo charcoal at an inhibition rate of 65% and an antimicrobial rate of 84%.

Advantageously, bamboo charcoal-based fabrics can be laundered, with little to no effect on the properties of the fabric and odor absorbers, and dry quickly due to the bamboo charcoal nanoparticles being are embedded in the fabric, and not coated onto the surface. Further, the bamboo charcoal is a conductive material, thereby reducing buildup of charges in fabric and consequently reducing static discharges.

Example 2

Figure 2:
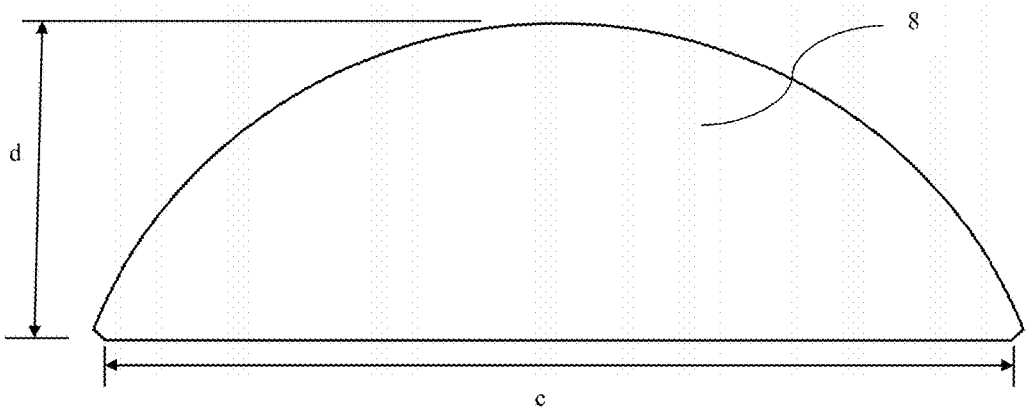
FIG. 2 is an illustration of the cover yoke for an embodiment of the invention.
Figure 3:
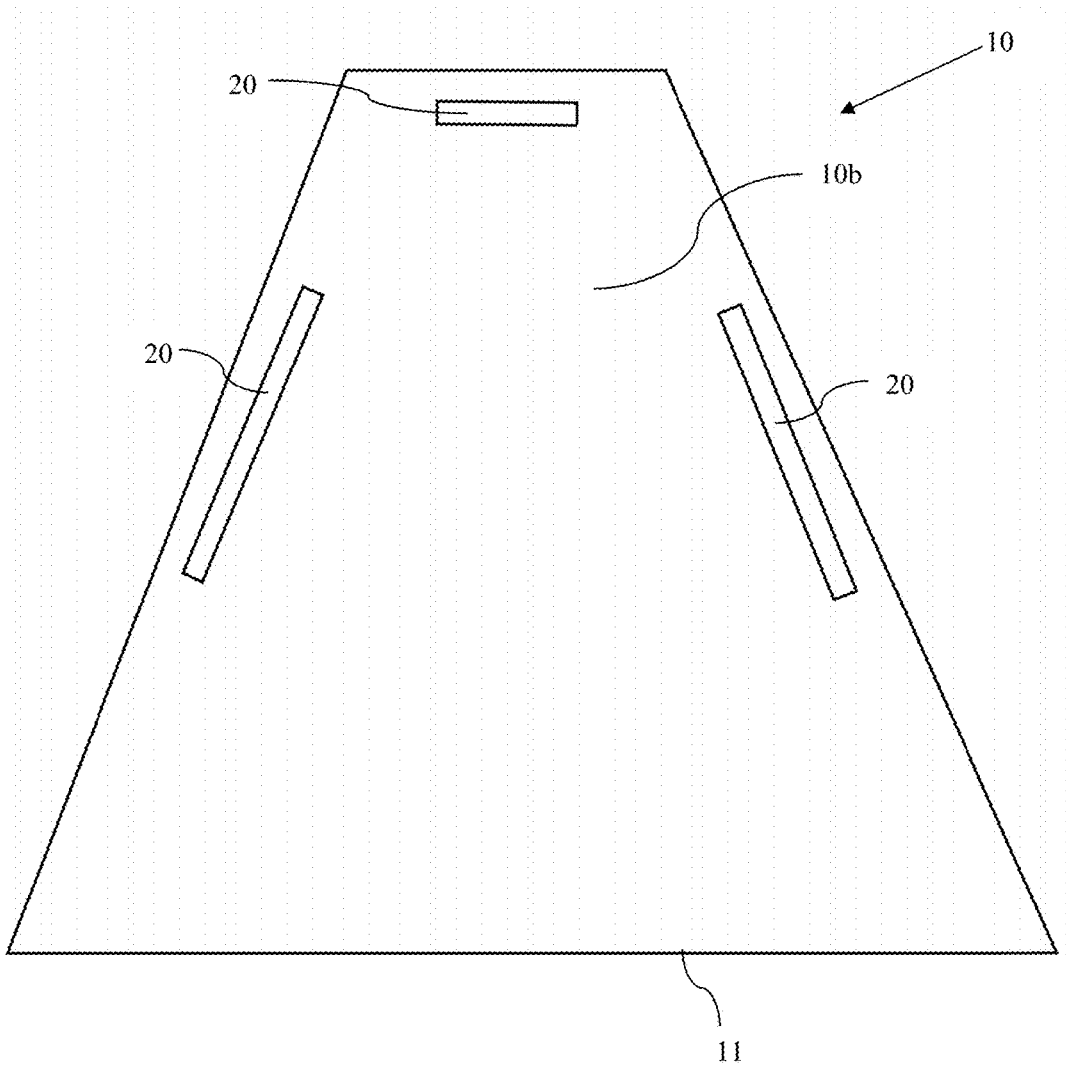
FIG. 3 is an illustration of the lid for an embodiment of the invention.

Receptacle cover 2 is formed from cover top 5, seen in FIG. 1, cover yoke 8, seen in FIG. 2, and lid 10, seen in FIG. 3, prepared from a fabric, such as bamboo charcoal fabric. Cover top 5 optionally is dimensioned such that the diameter of the top is 30 inches, dimension a is 5.5 inches and dimension b is 3.5 inches. In specific embodiments, fasteners 17 are 9 inches long and fastener 18 is 4 inches long. Cover yoke 8 optionally is sized such that dimension c is 26.5 inches and dimension d is 9 inches.

Figure 4:
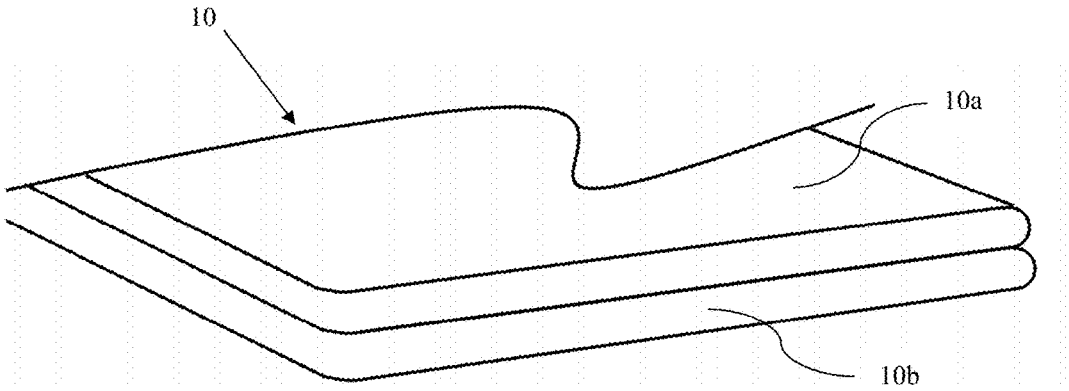
FIG. 4 is an illustration of the inner lid section and outer lid section stitched together to form the lid for an embodiment of the invention.
Figure 5:
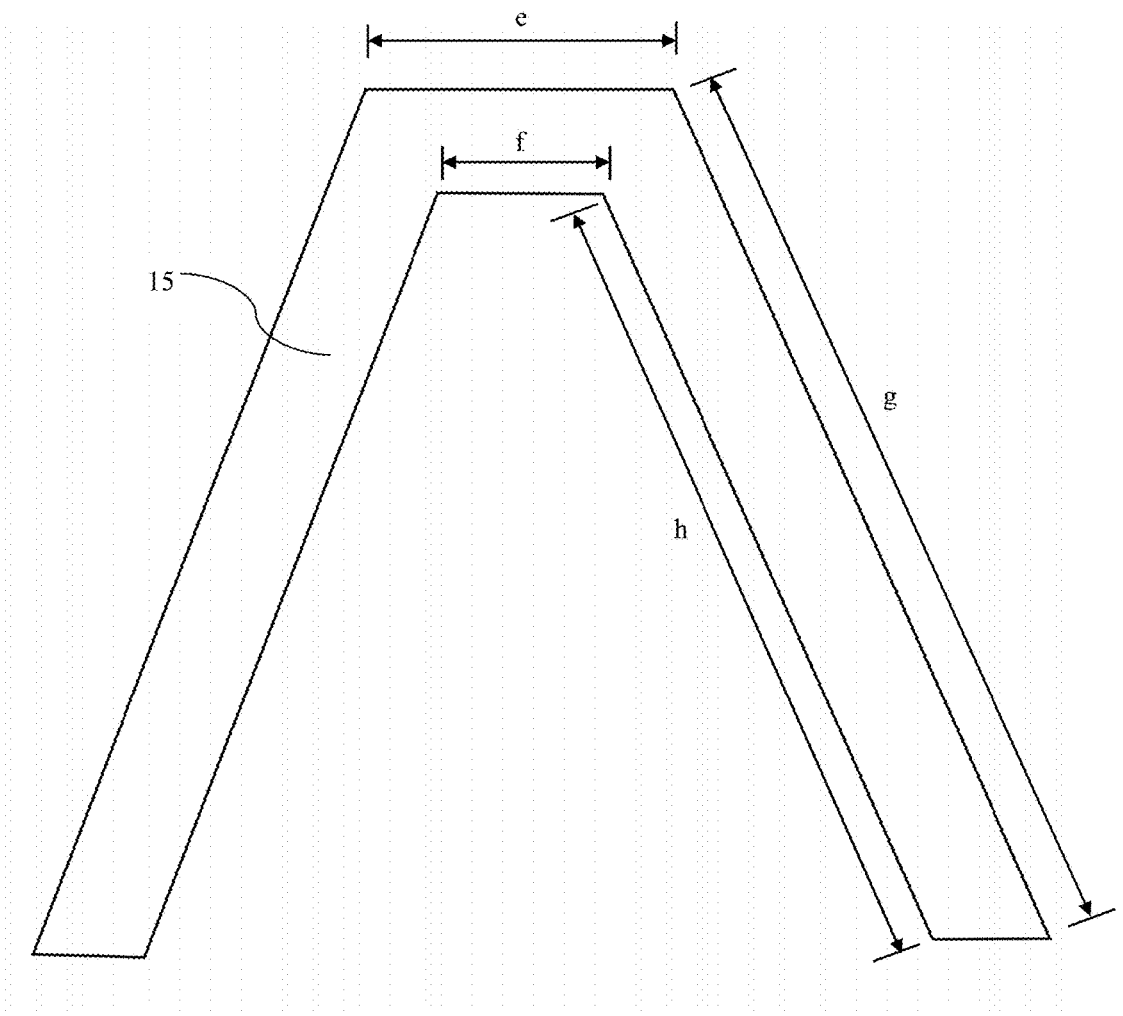
FIG. 5 is an illustration of the opening support for an embodiment of the invention.

Optionally, where the fabric is sufficiently wide, the fabric is folded in half widthwise and cut as multiple pieces simultaneously. The outer edge of cover top 5 was serged. Two complementary pieces of fabric, outer lid section 10*a* and inner lid section 10*b*, seen in FIG. 4, were stitched along the top edge, bottom edge and one side edge, leaving the one long connecting edge 11 open, to form lid 10. The lid sections were inverted through the open connecting edge 11, pressed and topstitch together. Opening support 15, seen in FIG. 5, was matched to opening 12 on cover top 5. Optionally, opening support 15 is sized such that dimension e is 6 inches, dimension f is 3.25 inches, dimension g is 18.25 inches, dimension h is 16 inches. The edges of opening support 15 were stitched to cover top 5. Cover top was flipped and topstitched. A plurality of fasteners 17, such as Velcro®, was topstitched to cover top 5 or opening support 15. Preferably, the Velcro® was stitched as seen in FIG. 1. At least one fastener 18, such as a piece male Velcro®, was box stitched to cover top 5. In some embodiments, the section of Velcro® was a six inch section of male Velcro®. Complementary fasteners 20, such as pieces of Velcro®, complementary to fasteners 17 and 18, were box stitched to lid 10. In some embodiments, complementary fasteners 20 were stitched to inner lid section 10*b* prior to stitching outer lid section 10*a* to inner lid section 10*b*. Lid 10 was basted to opening support 15, then stitched along edge 11 of the lid to cover yoke 8.

Casing 25 was formed from double-fold bias tape was stitched together and the seams pressed open. The ends of the bias tape were cut perpendicular to the longitudinal axis of the tape and a section of the end was folded over on the tape. In specific embodiments, ¼" was folded over. The end was folded over again and stitched. This was repeated for the opposite end of the bias tape. Cord 28 was placed in the bias tape. Casing 25 was formed by folding the bias tape over cord 28, with the wrong sides of the bias tape placed together. Casing 25 was folded in half with a section of cord 28 extended beyond the ends of the bias tape, and stitched to the circular edge of the cover. The remaining edge of the bias tape was then serged and topstitched to the cover.

Figure 6:
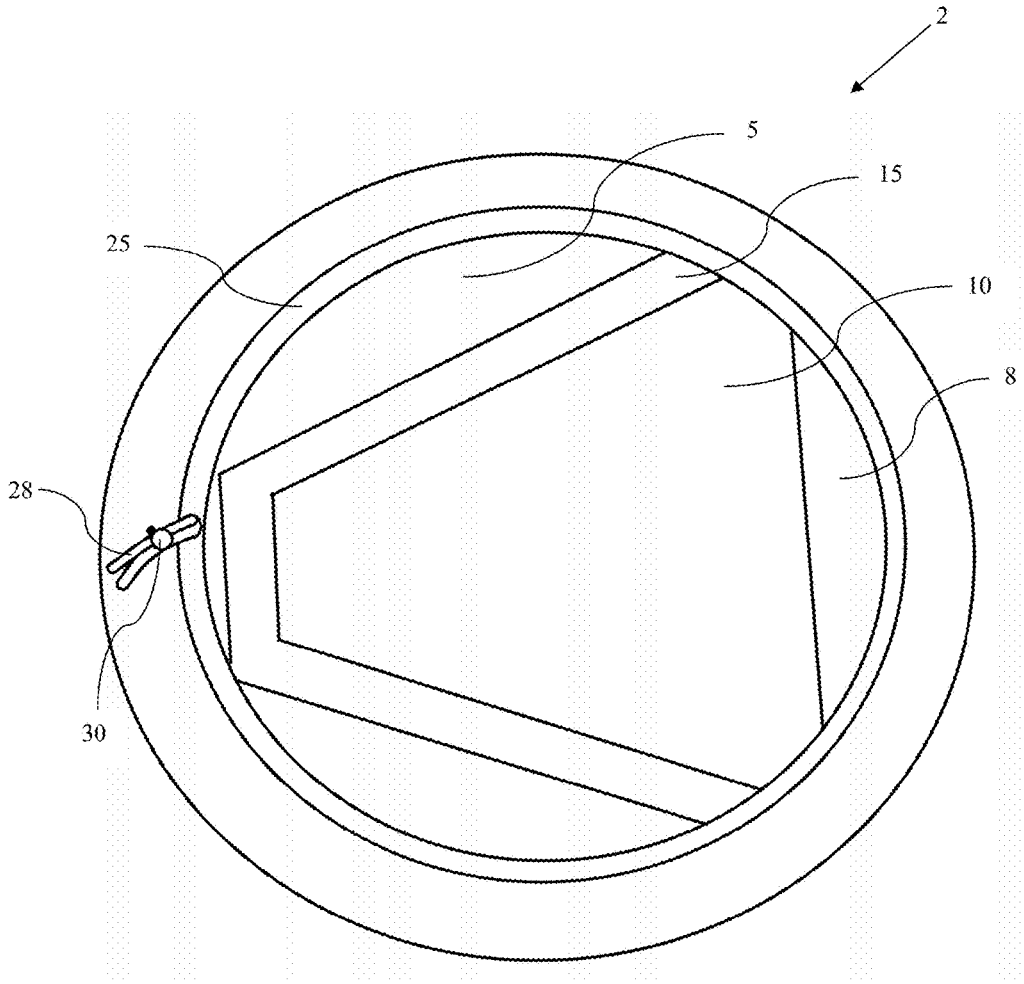
FIG. 6 is a bottom-up illustration of the assembled receptacle cover showing a first embodiment of the invention.

Cord lock 30 was attached to each end of cord 28, as seen in FIG. 6.

Example 3

Figure 7:
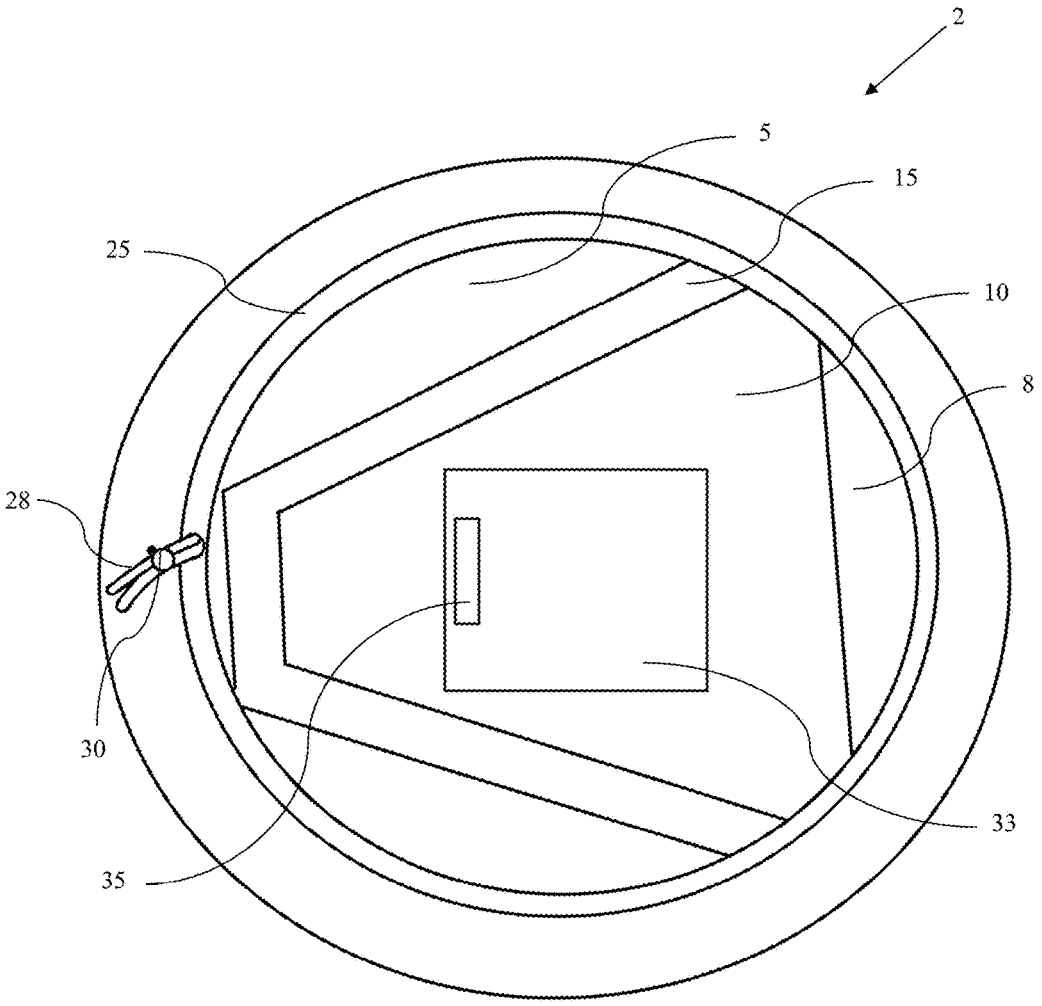
FIG. 7 is a bottom-up illustration of the assembled receptacle cover showing a second embodiment of the invention.

Cover was manufactured as described in the previous example using linen, cotton, silk, polyester, and woven cotton or other textile. Preferably, receptacle cover 2 comprises between 2 and 5 layers of material. Odor pocket 33 was fixed to receptacle cover 2, thereby providing odor absorbing capabilities. Odor pocket 33 was formed by stitching odor pocket fastener 35, such as female Velcro®, to a section of mesh or other odor transparent material and complementary odor pocket fastener 36, such as male Velcro®, to inner lid section 10*b*, as seen in FIG. 7. Prior to stitching inner lid section 10*b* to outer lid section 10*a*, the mesh or other odor transparent material was placed adjacent to inner lid section 10*b*, with the complementary Velcro sections aligned, and with the edges of the mesh pocket folded over. The mesh was box stitched to inner lid section 10*b* on three edges, thereby forming odor pocket 33. Inner lid section 10*b* was then stitched to outer lid section 10*a*, as described in the previous Example and the parts assembled as previously described.

Example 4

Figure 8:
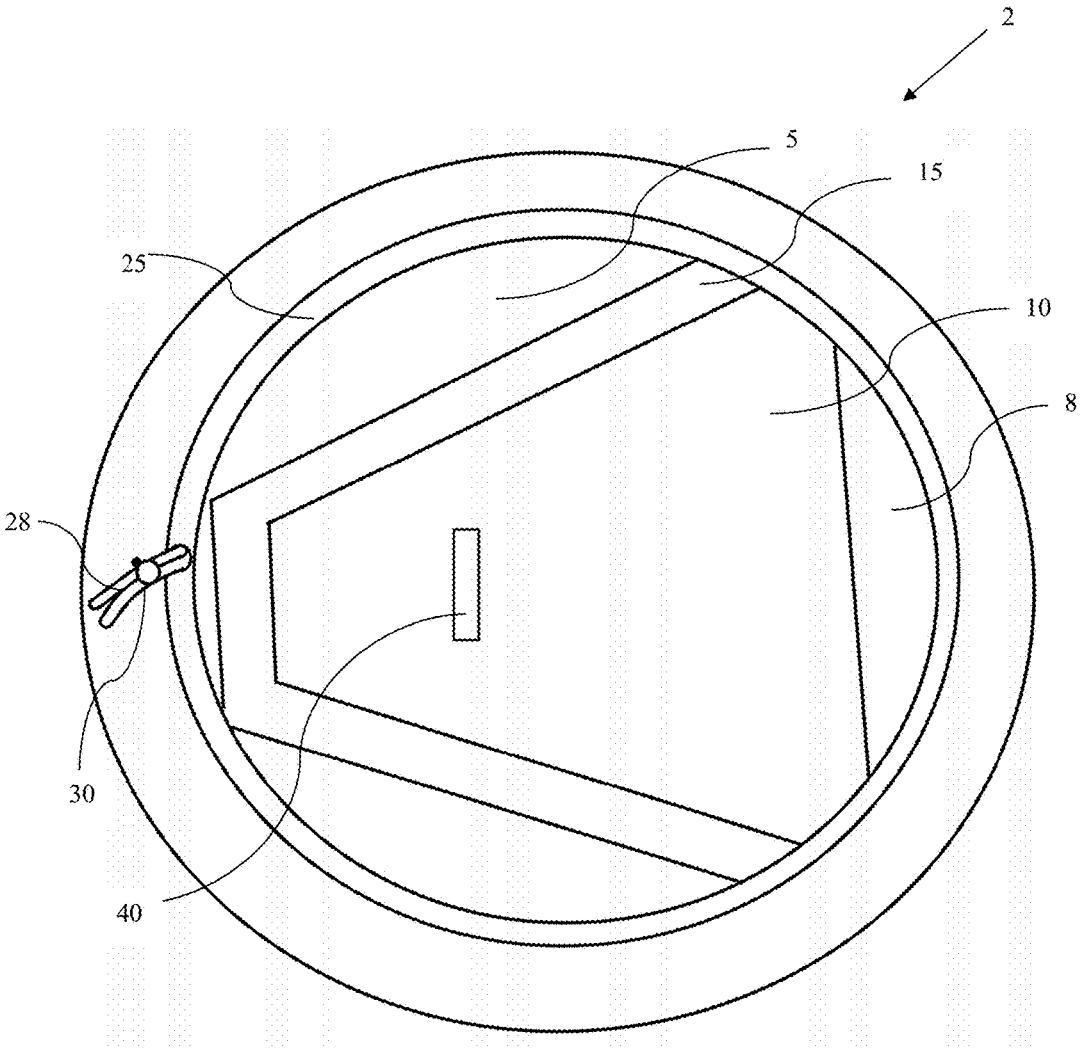
FIG. 8 is a bottom-up illustration of the assembled receptacle cover showing a third embodiment of the invention.
Figure 9:
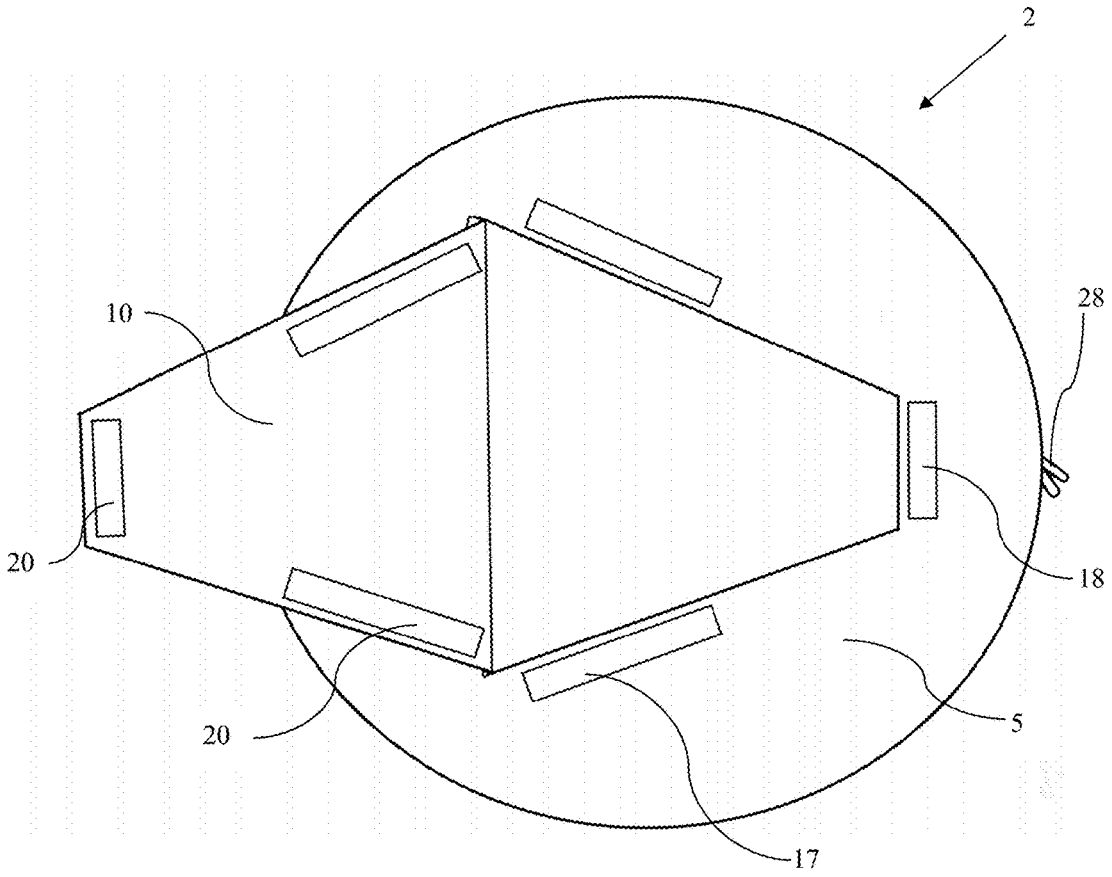
FIG. 9 is a top-down illustration of the assembled receptacle cover showing a first embodiment of the invention.

Cover was manufactured as described in the Example 1 using linen, cotton, silk, polyester, and woven cotton or other textile. Preferably, receptacle cover 2 comprises between 2 and 5 layers of material. Odor absorber attachment 40 was fixed to receptacle cover 2, thereby providing odor absorbing capabilities, as seen in FIG. 8. Odor absorber attachment 40 was formed by stitching absorber fastener 42, such as Velcro®, to inner lid section 10*b* prior to stitching inner lid section 10*b* to outer lid section 10*a*, as seen in FIG. 9. Inner lid section 10*b* was then stitched to outer lid section 10*a*, as described in Example 1 and the parts assembled as previously described.

Example 5

Figure 10:
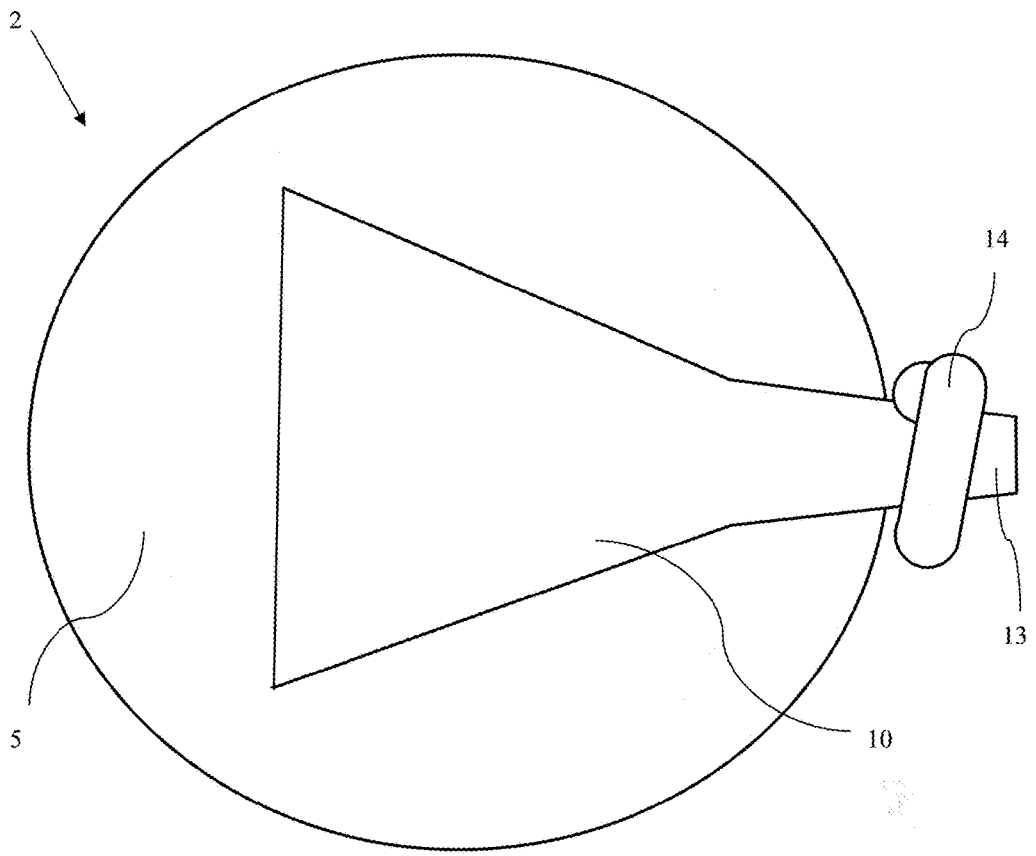
FIG. 10 is a top-down illustration of the assembled receptacle cover showing a fourth embodiment of the invention.

Cover was manufactured as described in the previous example using bamboo charcoal-doped synthetic fabric, bamboo charcoal-doped cotton, bamboo charcoal-doped bamboo fabric linen, linen, cotton, silk, polyester, and woven cotton or other textile. The cover may be manufactured as described in any of the previous examples. Lid 10 includes handle 13 as seen in FIG. 10. Handle 13 is optionally a strip of fabric, such as bamboo charcoal-doped synthetic fabric, bamboo charcoal-doped cotton, bamboo charcoal-doped bamboo fabric linen, linen, cotton, silk, polyester, and woven cotton or other textile. Alternatively, handle 13 is a strip of fabric having knot 14 disposed on handle 13.

Example 6

Figure 11:
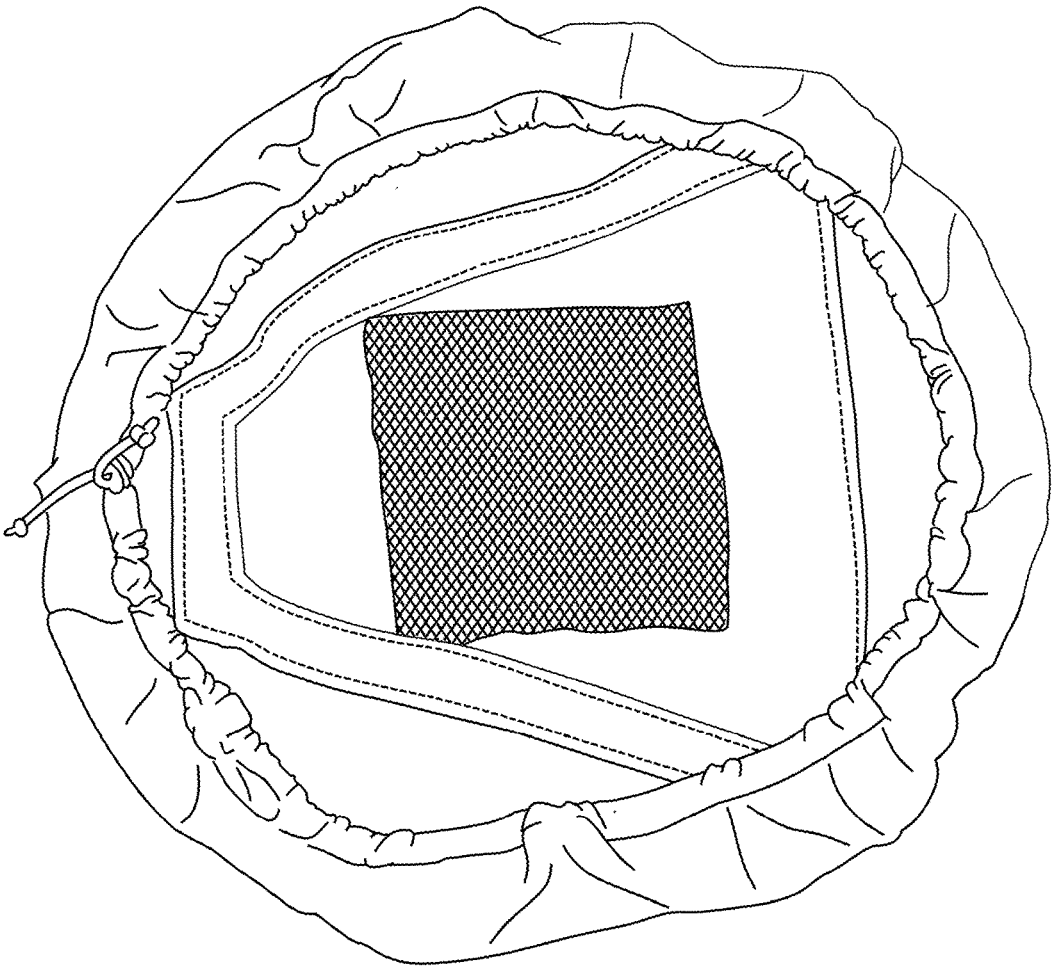
FIG. 11 is a top-down image of the assembled receptacle cover showing a first embodiment of the invention.
Figure 12:
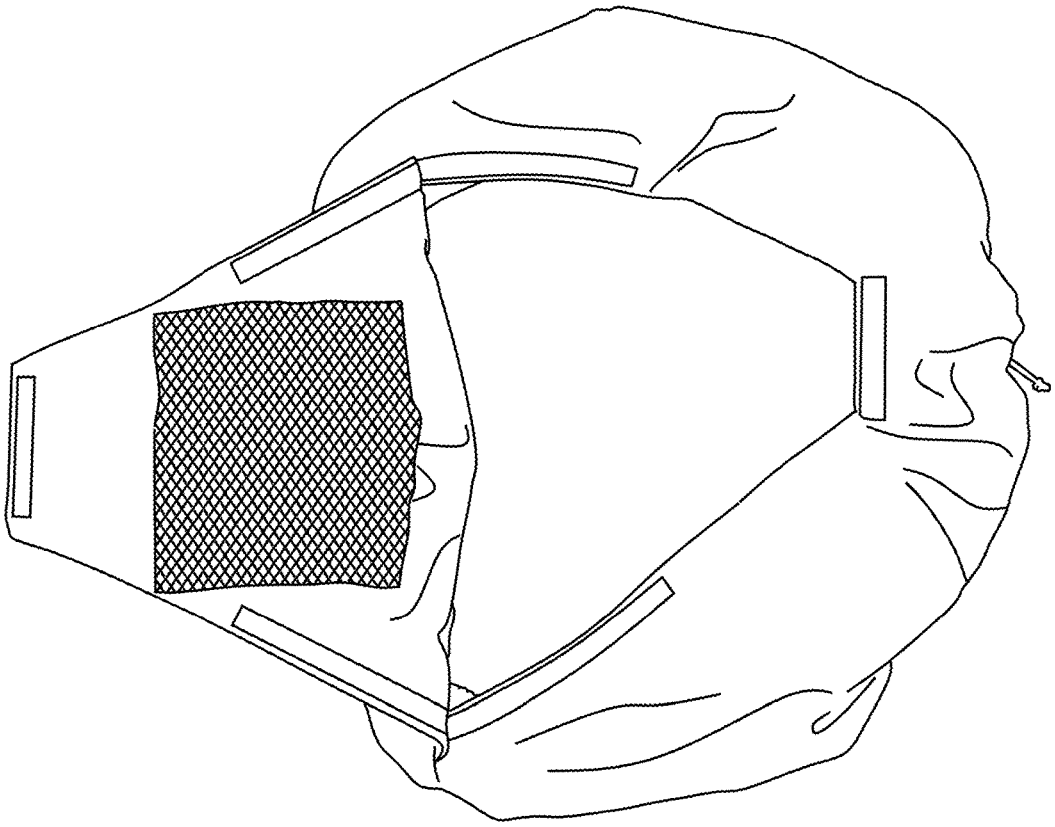
FIG. 12 is a bottom-up image of the assembled receptacle cover showing a first embodiment of the invention.

Cover 2, disclosed in Examples 1-6, is placed onto receptacle 50, such as those seen in FIGS. 11 and 12. Cord 28 was tightened around the opening of receptacle 50 and cord lock 30 advanced on cord 28 to affix cover 2 on receptacle 50. To access receptacle 50, lid 10 was elevated, thereby separating fasteners 17 and 18 from complementary fasteners 20. Laundry, or other products, are placed in receptacle 50, and lid 10 lowered, reengaging fasteners 17 and 18 with complementary fasteners 20. Advantageously, the odor absorbers eliminate smells from the products.

In the preceding specification, all documents, acts, or information disclosed do not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

While there has been described and illustrated specific embodiments of an odor-neutralizing sheath, it will be apparent to those skilled in the art that variations and modifications are possible without deviating from the broad spirit and principle of the present invention. It is also to be understood that the following claims are intended to cover all of the generic and specific features of the invention herein described, and all statements of the scope of the invention which, as a matter of language, might be said to fall therebetween.

What is claimed is:

1. A receptacle cover, comprising:

at least one piece of fabric, wherein the at least one piece of fabric forms a horizontal wall; or at least one vertical wall and a horizontal wall;

an opening disposed on the horizontal wall;

a fabric lid connected to the horizontal wall by a first seam along a first edge, wherein the lid is dimensioned to cover the opening disposed on the horizontal wall;

a casing connected to the horizontal wall or the at least one vertical wall by a second seam;

a first tightener disposed in the casing, wherein the first tightener is an elastic band, an elastic cord, or a non-elastic cord;

wherein the fabric is an odor-eliminating material; or the fabric is not an odor-eliminating material and an odor eliminator is disposed on the horizontal wall or the at least one vertical wall;

where the odor eliminator is activated carbon fiber, activated carbon non-woven fabric, bamboo charcoal, or a combination thereof;

a handle disposed opposite the first edge of the lid; and a knot disposed on the handle, wherein the handle is fabric.

2. The receptacle cover of claim 1, wherein the at least one vertical wall further comprises a first vertical wall, a second vertical wall, a third vertical wall, and a fourth vertical wall, wherein the first vertical wall, the second vertical wall, the third vertical wall, and the fourth vertical wall are disposed to form a polygon.

3. The receptacle cover of claim 1, further comprising a second tightener, wherein the second tightener is an elastic band, elastic cord, or drawstring disposed on the at least one vertical wall.

4. The receptacle cover of claim 1, wherein the odor eliminator is fixed to the horizontal wall by adhesive, sewing, snaps, zippers, hook and loop fasteners, buttons, acrylic gel, fusable webbing, or fusable material.

5. The receptacle cover of claim 1, wherein the fabric is bamboo charcoal-doped synthetic fabric, bamboo charcoal-doped cotton, bamboo charcoal-doped bamboo fabric linen, cotton, silk, polyester, or woven cotton.

6. The receptacle cover of claim 1, wherein the odor eliminating compound further comprises baking soda, white vinegar, activated carbon, essential oils, or a combination thereof.

7. The receptacle cover of claim 1, wherein the tightener is an elastic cord or a non-elastic cord, where the non-elastic cord is a drawstring.

8. The receptacle cover of claim 7, further comprising a lock disposed on the tightener, wherein the lock is adapted to accept a plurality of ends of the tightener; and wherein the lock is adapted to secure the tightener at a selected length.

9. The receptacle cover of claim 1, wherein the lid is trapezoidal or triangular.

10. A receptacle cover, comprising:

at least one piece of fabric, wherein the at least one piece of fabric forms a horizontal wall; or at least one vertical wall and a horizontal wall;

an opening disposed on the horizontal wall;

a fabric lid connected to the horizontal wall by a first seam along a first edge, wherein the lid is dimensioned to cover the opening disposed on the horizontal wall;

a casing connected to the horizontal wall or the at least one vertical wall by a second seam;

a first tightener disposed in the casing, wherein the tightener is an elastic band, an elastic cord, or a non-elastic cord;

wherein the fabric is a bamboo charcoal-impregnated fabric;

a handle disposed opposite the first edge of the lid; and a knot disposed on the handle, wherein the handle is fabric.

11. The receptacle cover of claim 10, wherein the at least one vertical wall further comprises a first vertical wall, a second vertical wall, a third vertical wall, and a fourth vertical wall, wherein the first vertical wall, the second vertical wall, the third vertical wall, and the fourth vertical wall are disposed to form a polygon.

12. The receptacle cover of claim 10, further comprising a second tightener, wherein the second tightener is an elastic band, elastic cord, or drawstring disposed on the at least one vertical wall.

13. The receptacle cover of claim 10, wherein the bamboo charcoal-impregnated fabric is bamboo charcoal-doped synthetic fabric, bamboo charcoal-doped cotton, bamboo charcoal-doped bamboo fabric, or a combination thereof.

14. The receptacle cover of claim 10, wherein the first tightener is the elastic cord or the non-elastic cord, where the non-elastic cord is a drawstring.

15. The receptacle cover of claim 14, further comprising a lock disposed on the tightener, wherein the lock is adapted to accept a plurality of ends of the tightener; and wherein the lock is adapted to secure the tightener at a selected length.

16. The receptacle cover of claim 10, wherein the lid is trapezoidal or triangular.

* * * * *